US008983851B2

(12) United States Patent
Rettelbach et al.

(10) Patent No.: US 8,983,851 B2
(45) Date of Patent: Mar. 17, 2015

(54) NOISE FILER, NOISE FILLING PARAMETER CALCULATOR ENCODED AUDIO SIGNAL REPRESENTATION, METHODS AND COMPUTER PROGRAM

(75) Inventors: Nikolaus Rettelbach, Nuremberg (DE); Bernhard Grill, Lauf (DE); Guillaume Fuchs, Nuremberg (DE); Stefan Geyersberger, Wuerzburg (DE); Markus Multrus, Nuremberg (DE); Harald Popp, Tuchenbach (DE); Juergen Herre, Buckenhof (DE); Stefan Wabnik, Ilmenau (DE); Gerald Schuller, Erfurt (DE); Jens Hirschfeld, Heringen (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 1010 days.

(21) Appl. No.: 13/004,493

(22) Filed: Jan. 11, 2011

(65) Prior Publication Data

US 2011/0173012 A1 Jul. 14, 2011

Related U.S. Application Data

(63) Continuation of application No. PCT/EP2009/004653, filed on Jun. 26, 2009.

(60) Provisional application No. 61/079,872, filed on Jul. 11, 2008, provisional application No. 61/103,820, filed on Oct. 8, 2008.

(51) Int. Cl.
*G10L 19/00* (2013.01)
*G10L 19/032* (2013.01)

(Continued)

(52) U.S. Cl.
CPC ..... *G10L 19/032* (2013.01); *G10L 19/02* (2013.01); *G10L 19/028* (2013.01); *G10L 19/0204* (2013.01); *G10L 19/035* (2013.01); *G10L 25/18* (2013.01)
USPC ..... 704/500; 704/501; 704/226; 704/210; 704/215

(58) Field of Classification Search
USPC ..... 704/500, 501, 226, 210, 215
See application file for complete search history.

(56) References Cited

U.S. PATENT DOCUMENTS 4,703,505 A 10/1987 Seiler et al.
4,956,871 A 9/1990 Swaminathan (Continued)

FOREIGN PATENT DOCUMENTS

EP 0968497 1/2000
EP 1395980 3/2004

(Continued)

OTHER PUBLICATIONS

"Extended Adaptive Multi-Rate—Wideband (AMR-WB+) codec", 3rd Generation Partnership Project; 3GPP TS 26.290 V6.1.0, Dec. 2004, 86 pages.

(Continued)

*Primary Examiner* — Qi Han
(74) *Attorney, Agent, or Firm* — Perkins Coie LLP; Michael A. Glenn

(57) ABSTRACT

A noise filler for providing a noise-filled spectral representation of an audio signal on the basis of an input spectral representation of the audio signal has a spectral region identifier configured to identify spectral regions of the input spectral representation spaced from non-zero spectral regions of the input spectral representation by at least one intermediate spectral region, to obtain identified spectral regions, and a noise inserter configured to selectively introduce noise into the identified spectral regions to obtain the noise-filled spectral representation of the audio signal. A noise filling parameter calculator for providing a noise filling parameter on the basis of a quantized spectral representation of an audio signal has a spectral region identifier, as mentioned above, and a noise value calculator configured to selectively consider quantization errors of the identified spectral regions for a calculation of the noise filling parameter. Accordingly, an encoded audio signal representation representing the audio signal can be obtained.

15 Claims, 9 Drawing Sheets

(51) Int. Cl.

| | |
|---|---|
| ***G10L 19/02*** | (2013.01) |
| ***G10L 19/028*** | (2013.01) |
| *G10L 19/035* | (2013.01) |
| *G10L 25/18* | (2013.01) |

(56) References Cited

U.S. PATENT DOCUMENTS

| | | | | |
|---|---|---|---|---|
| 5,960,389 | A | 9/1999 | Jarvinen et al. | |
| 6,240,386 | B1 | 5/2001 | Thyssen et al. | |
| 7,124,079 | B1 | 10/2006 | Ekudden et al. | |
| 7,275,936 | B1 | 10/2007 | Ju et al. | |
| 7,337,118 | B2 | 2/2008 | Davidson et al. | |
| 7,613,603 | B2 | 11/2009 | Yamashita | |
| 8,275,611 | B2 | 9/2012 | Zong et al. | |
| 2002/0128838 | A1 | 9/2002 | Veprek | |
| 2003/0061055 | A1* | 3/2003 | Taori et al. | 704/500 |
| 2003/0233234 | A1 | 12/2003 | Truman et al. | |
| 2004/0002854 | A1 | 1/2004 | Ha | |
| 2005/0027520 | A1 | 2/2005 | Mattila et al. | |
| 2005/0122961 | A1 | 6/2005 | Ban | |
| 2005/0261892 | A1 | 11/2005 | Makinen et al. | |
| 2005/0278171 | A1 | 12/2005 | Suppappola et al. | |
| 2006/0136198 | A1 | 6/2006 | Kim et al. | |
| 2006/0241940 | A1 | 10/2006 | Ramprashad et al. | |
| 2007/0016403 | A1 | 1/2007 | Schuller et al. | |
| 2007/0162278 | A1 | 7/2007 | Miyasaka et al. | |
| 2007/0247383 | A1 | 10/2007 | Krupa et al. | |
| 2007/0274383 | A1 | 11/2007 | Yu et al. | |
| 2007/0282603 | A1 | 12/2007 | Bessette | |
| 2009/0192791 | A1 | 7/2009 | El-Maleh et al. | |
| 2009/0306992 | A1 | 12/2009 | Ragot et al. | |
| 2010/0241437 | A1* | 9/2010 | Taleb et al. | 704/500 |
| 2011/0170711 | A1 | 7/2011 | Rettelbach et al. | |
| 2011/0264454 | A1* | 10/2011 | Ullberg et al. | 704/500 |

FOREIGN PATENT DOCUMENTS

| | | | |
|---|---|---|---|
| EP | 1087379 | | 6/2005 |
| EP | 1736966 | | 12/2006 |
| JP | H09-34493 | | 2/1997 |
| RU | 2237296 | | 9/2004 |
| RU | 2289858 | | 12/2006 |
| RU | 2294565 | | 2/2007 |
| TW | 454170 | | 9/2001 |
| WO | WO-0241302 | | 5/2002 |
| WO | 02/091363 | A1 | 11/2002 |
| WO | WO-02/091363 | | 11/2002 |
| WO | WO-2005004113 | | 1/2005 |
| WO | WO-2005/078704 | | 8/2005 |
| WO | WO-2005/081229 | | 9/2005 |
| WO | 2009/029036 | | 3/2009 |

OTHER PUBLICATIONS

"Information Technology—Generic coding of moving pictures and associated audio information-Part 7: Advanced Audio Coding (AAC)", International Standard, ISO/IEC 13818-7, Second edition, 2003, 198 pages.

Herre, Juergen et al., "Overview of MPEG-4 Audio and Its Applications in Mobile Communications", IEEE Int'l Conference on Signal Processing, XP010526820, Aug. 21, 2000, pp. 604-613.

Ragot, Stephane et al., "ITU-T G.729.1: AN 8-32 Kbits/S Scalable Coder Interoperable With G.729 for Wideband Telephony and Voice Over IP", Int'l Conference on Acoustics, Speech, and Signal Processing, Honolulu, Hawaii, USA, Apr. 20, 2007, pp. IV-529-IV-532.

"Audio codec processing functions; Extended Adaptive Multi-Rate—Wideband (AMR-WB+) codec; Conformance testing (Release 7)", 3rd Generation Partnership Project; Technical Specification Group Services and System Aspects, ARIB STD-T63-26.274 V7.0.0, Jun. 2007, pp. 1-21.

* cited by examiner

300

```
% Pseudo code noise filling decoder side
% Detect Regions
R = {};
MinimalRunLength = 8;
For (all lines in the second half of the spectra)
    E=0


    For (i from line index - (MinimalRunLength)/2 to line
index + (MinimalRunLength)/2)
        E=E+quantized(x(i));
    End for
    If E==0
        R = {R, line index};
    End if
End for

%Decode noise floor
nf_decoded = 0.0625*(8-index);

%Fill with noise
For (all i in R)
    x(i) = random (-1,+1)*nf_decoded;
End for

%End of pseudo-code noise filling decoder side
```

310

320

330

FIG 3

600

```
% Pseudo of code noise filling encoder side

610 % Detect Regions
    R = {};
    MinimalRunLength = 8;
    For (all lines in the second half of the spectra)
        E=0
        For (i from line index - (MinimalRunLength)/2 to line
    index + (MinimalRunLength)/2)
                E=E+quantized(x(i));
        End for
        If E==0
                R = {R, line index};
        End if
    End for

620 %Compute noise floor
    nf = 0;
    n=0;
    For (all i in R)
        nf = E+log10(energy(x(i)));
        n = n+1;
    End for

630 %Quantize nf
    index=max(0, min (7, int (8-16*power (10, (nf/ (2*n))))));

% end of pseudo code noise filling encoder side
```

FIG 6

NOISE FILER, NOISE FILLING PARAMETER CALCULATOR ENCODED AUDIO SIGNAL REPRESENTATION, METHODS AND COMPUTER PROGRAM

CROSS-REFERENCE TO RELATED APPLICATIONS

This application is a continuation of copending International Application No. PCT/EP2009/004653, filed Jun. 26, 2009, which is incorporated herein by reference in its entirety, and additionally claims priority from U.S. applications Nos. U.S. No. 61/079,872, filed Jul. 11, 2008, and U.S. No. 61/103,820 filed Oct. 8, 2008, which are all incorporated herein by reference in their entirety.

BACKGROUND OF THE INVENTION

Embodiments according to the invention are related to a noise filler for providing a noise-filled spectral representation of an audio signal on the basis of an input spectral representation of the audio signal, to a noise filling parameter calculator for providing a noise filling parameter on the basis of a quantized spectral representation of an audio signal, to an encoded audio signal representation representing an audio signal, to a method for providing a noise filled spectral representation of an audio signal, to a method for providing a noise filling parameter on the basis of a quantized spectral representation of an audio signal, and to computer programs for implementing said methods.

In the following, some scenarios will be described in which embodiments according to the invention can be applied with advantage. Many frequency domain audio signal encoders are based on the idea that some frequency regions or spectral regions (e.g. frequency lines or spectral lines provided by a time-domain to frequency-domain conversion), are more important that other spectral regions. Accordingly, spectral regions of high psychoacoustic relevance are typically encoded with higher accuracy than spectral regions of lower psychoacoustic relevance. The psychoacoustic relevance of the different spectral regions may, for example, be calculated using a psychoacoustic model which takes into account the masking of weaker spectral regions by adjacent strong spectral peaks.

If there is a desire to reduce the bitrate of an encoded audio signal down towards a low level, some spectral regions are quantized with a very low accuracy (e.g. only one bit accuracy, or two bit accuracy). Accordingly, many of the spectral regions quantized with low accuracy are quantized to zero. Thus, at low bitrates transform-based audio coders are prone to different artifacts and especially to artifacts originating from the zero-quantized frequency lines. Indeed, coarse quantization of spectral values in low bitrate audio coding might lead to very sparse spectra after inverse quantization, as many spectral lines might have been quantized to zero. These frequency holes in the reconstructed signal produce undesirable sound artifacts. It can make the reproduced sound too sharp or instable (birdies) when the frequency holes in the spectra move from frame to frame.

Noise filling is a means to mask these artefacts by filling, at the decoder side, the zero-quantized coefficients or bands with a random noise. The energy of the inserted noise is a parameter computed and transmitted by the encoder.

Different concepts of noise filling are known. For example, the so-called AMR-WR+ combines noise filling and a Discrete Fourier Transform (DFT), as described for example in reference [1]. In addition, the International Standard ITU-T G.729.1 defines a concept which combines noise filling and modified discrete cosine transform (MDCT). Details are described in reference [2].

Further aspects regarding the noise filling are described in the International patent application PCT/IB2002/001388 by Koninklijke Philips Electronics N.V. (see reference [3]).

Nevertheless, the conventional noise filling concepts result in audible distortions.

In view of this discussion, there is a desire to create a concept of noise filling which provides for an improved hearing impression.

SUMMARY

According to an embodiment, a noise filler for providing a noise-filled spectral representation of an audio signal on the basis of an input spectral representation of the audio signal may have a spectral region identifier configured to identify spectral regions of the input spectral representation which are quantized to zero and which are spaced from non-zero spectral regions of the input spectral representation by at least one intermediate spectral region, to acquire identified spectral regions; and a noise inserter configured to selectively introduce noise into the identified spectral regions to acquire the noise-filled spectral representation of the audio signal.

According to another embodiment, a noise filling parameter calculator for providing a noise filling parameter on the basis of a quantized spectral representation of an audio signal may have a spectral region identifier configured to identify spectral regions of the quantized spectral representation spaced from non-zero spectral regions of the quantized spectral representation by at least one intermediate spectral region, to acquire identified spectral regions; and a noise value calculator configured to selectively consider quantization errors of the identified spectral regions for a calculation of the noise filling parameter.

According to another embodiment, an encoded audio signal representation representing an audio signal may have an encoded quantized spectral domain representation of the audio signal; and an encoded noise filling parameter; wherein the noise filling parameter represents a quantization error of spectral regions of the spectral domain representation quantized to zero and spaced from spectral regions of the spectral domain representation quantized to a non-zero value by at least one intermediate spectral region.

According to another embodiment a method for providing a noise-filled spectral representation of an audio signal on the basis of an input spectral representation of the audio signal may have the steps of identifying spectral regions of the input spectral representation spaced from non-zero spectral regions of the input spectral representation by at least one intermediate spectral region, to acquire identified spectral regions; and selectively introducing noise into the identified spectral regions to acquire the noise-filled spectral representation of the audio signal.

According to another embodiment, a method for providing a noise filling parameter on the basis of a quantized spectral representation of an audio signal may have the steps of identifying spectral regions of the quantized spectral representation spaced from non-zero spectral regions of the quantized spectral representation by at least one intermediate spectral region to acquire identified spectral regions; and selectively considering quantization errors of the identified spectral regions for a calculation of the noise filling parameter.

According to another embodiment, a computer program may perform the method for providing a noise-filled spectral representation of an audio signal on the basis of an input spectral representation of the audio signal, which may have the steps of identifying spectral regions of the input spectral representation spaced from non-zero spectral regions of the input spectral representation by at least one intermediate spectral region, to acquire identified spectral regions; and selectively introducing noise into the identified spectral regions to acquire the noise-filled spectral representation of the audio signal, when the computer program runs on a computer.

According to another embodiment, a computer program may perform the method for providing a noise filling parameter on the basis of a quantized spectral representation of an audio signal, which may have the steps of identifying spectral regions of the quantized spectral representation spaced from non-zero spectral regions of the quantized spectral representation by at least one intermediate spectral region to acquire identified spectral regions; and selectively considering quantization errors of the identified spectral regions for a calculation of the noise filling parameter, when the computer program runs on a computer.

An embodiment according to the invention creates a noise filler for providing a noise-filled spectral representation of an audio signal on the basis of an input spectral representation of the audio signal. The noise filler comprises a spectral region identifier configured to identify spectral regions (e.g. spectral lines, or spectral bins) of the input spectral representation spaced from non-zero spectral regions (e.g. spectral lines or spectral bins) of the input spectral representation by at least one intermediate spectral region, to obtain identified spectral regions. The noise filler also comprises a noise inserter configured to selectively introduce noise into the identified spectral regions (e.g. spectral lines or spectral bins) to obtain the noise-filled spectral representation of the audio signal.

This embodiment of the present invention is based on the finding that tonal components of the spectral representation of an audio signal are typically degraded, in terms of the hearing impression, if a noise filling is applied in the immediate neighborhood of such tonal components. Accordingly, it has been found that an improved hearing impression of a noise-filled audio signal can be obtained if the noise filling is only applied to spectral regions which are spaced away from such tonal, non-zero spectral regions. Accordingly, the tonal components of the audio signal spectrum (which are not quantized to zero in the quantized spectral representation input to the noise filler) remain audible (i.e. do not become smeared with closely adjacent noise), while the presence of large spectral holes is still efficiently avoided.

In an embodiment, the spectral region identifier is configured to identify spectral lines of the input spectral representation, which are quantized to zero and which comprise at least a first predetermined number of lower frequency neighbor spectral lines quantized to zero and at least a second predetermined number of higher frequency neighbor spectral line quantized to zero, as identified spectral regions, wherein the first predetermined number is greater than or equal to one and wherein the second predetermined number is greater than or equal to one. In this embodiment, the noise inserter is configured to selectively introduce noise into the identified spectral lines while leaving spectral lines quantized to a non-zero value and spectral lines quantized to zero, but not having the first predetermined number of lower frequency neighbor spectral lines quantized to zero, or the second predetermined number of higher frequency neighbor spectral lines quantized to zero unaffected by the noise filling. Thus, the noise filling is selective in that noise is introduced only into spectral lines which are quantized to zero and which are spaced from lines quantized to a non-zero value, both in an upward spectral direction and a downward spectral direction, for example by the first predetermined number of lower frequency neighbor spectral lines quantized to zero and by the second predetermined number of higher frequency neighbor spectral lines quantized to zero.

In an embodiment, the first predetermined number is equal to the second predetermined number, such that a minimum spacing in the upward frequency direction from lines quantized to a non-zero value is equal to a minimum spacing in the downward frequency direction from lines quantized to a non-zero value.

In an embodiment, the noise filler is configured to introduce noise only into spectral regions in an upper portion of the spectral representation of the audio signal, while leaving a lower portion of the spectral representation of the audio signal unaffected by the noise filling. Such a concept is useful as usually the higher frequencies are less perceptually important than the low frequencies. The zero quantized values also mostly occur in the second half of the spectra (i.e. for high frequencies). Also adding noise in the high frequencies is less prone to get a final noisy sound restitution.

In an embodiment, the spectral region identifier is configured to sum quantized intensity values (e.g. energy values or amplitude values) of spectral regions in a predetermined double-sided spectral neighborhood of a given spectral region (i.e. a spectral neighborhood extending towards both lower and higher frequencies), to obtain a sum value, and to evaluate the sum value to decide whether the given spectral region is an identified spectral region or not. It has been found that a sum value of energies of a quantized spectrum over a double-sided spectral neighborhood of a given spectral region is a meaningful quantity to decide whether noise filling should be applied to the given spectral region.

In another embodiment, the spectral region identifier is configured to scan a range of spectral regions of the input spectral representation to detect contiguous sequences of spectral regions quantized to zero, and to recognize one or more central spectral regions (i.e. non-boundary spectral regions) of such detected contiguous sequences as identified spectral regions.

It has been found that a detection of a certain "run-length" of spectral regions quantized to zero, is a task which can be implemented with particularly low computational complexity. In order to identify such a contiguous sequence of spectral regions, it is possible to decide whether all of the spectral regions within this sequence of spectral regions are quantized to zero, which can be performed using a relatively simple algorithm or circuit. If it is found that such a contiguous sequence of spectral regions is quantized to zero, one or more of the inner spectral regions of the sequence (which are spaced far enough from spectral regions outside of the present sequence of spectral regions) are treated as identified spectral regions. Thus, by scanning through a range of spectral regions (e.g. by subsequently selecting different shifted sequences of spectral regions), an efficient analysis of the spectral representation can be made, to identify spectral regions quantized to zero and spaced from spectral regions quantized to a non-zero value by a predetermined minimum distance.

Another embodiment according to the invention creates a noise filling parameter calculator for providing a noise filling parameter on the basis of a quantized spectral representation of an audio signal. The noise filling parameter calculator comprises a spectral region identifier configured to identify spectral regions of the quantized spectral representation spaced from non-zero spectral regions of the quantized spectral representation by at least one intermediate spectral region, to obtain identified spectral regions. The noise filling parameter calculator also comprises a noise value calculator configured to selectively consider quantization errors of the identified spectral regions for a calculation of the noise filling parameter. The noise filling parameter calculator is based on the key idea that it is desirable to restrict a decoder-sided noise filling to spectral regions which are spaced from tonal spectral regions (quantized to a non-zero value), and that consequently the noise parameter should be calculated at the encoder side, taking this concept into consideration. Accordingly, a noise filling parameter is obtained which is particularly well-suited to the above-described decoder concept. It has also been found that spectral regions, which are quantized to zero, but which are very close to spectral regions quantized to a non-zero value, often do not reflect a truly noise-like audio content, but rather are strongly correlated with the adjacent tonal (quantized to a non-zero value) spectral region. Accordingly, it has been found that it is generally not desirable to consider the quantization error of spectral regions, which are nearby spectral regions quantized to a non-zero value for a calculation of a noise filling parameter, because this would typically result in a strong over-estimation of the noise, thereby resulting in a too noisy reconstructed spectral representation.

Thus, the noise filling parameter calculation concept described herein is usable in combination with the above-described noise filling concept and even in combination with conventional noise filling concepts.

In embodiments, the concept for the identification of spectral regions, which has been discussed with respect to the noise filler, can also be applied in combination with the noise filling parameter calculator.

In a further embodiment, the noise value calculator is configured to consider an actual energy of the quantization error of the identified spectral regions for the calculation of the noise filling parameter. It has been found that the consideration of an actual quantization error (rather than an estimated quantization error or an average quantization error) typically brings along improved results, because the actual quantization error typically deviates from the statistically expected quantization error.

In a further embodiment, the noise value calculator is configured to emphasize a non-tonal quantization error energy distributed over a plurality of identified spectral regions in relation to a tonal quantization error energy concentrated in a single spectral region. This concept is based on the finding that a non-tonal wideband noise, an average energy of which lies below a quantization threshold and which is therefore quantized to zero, is perceptually much more relevant for the noise filler than a single tonal audio component, an intensity of which lies below the quantization threshold, even if the non-tonal wideband noise quantized to zero and the tonal component quantized to zero were both quantized to zero. The reason is that the noise filler by generating a random noise at the decoder can model missing non-tonal wideband noise in the quantized spectral representation but not missing tonal components. Thus, an emphasis of non-tonal noise components quantized to zero over tonal components quantized to zero, brings along a more realistic sound reconstruction. This is also due to the fact that a human hearing impression is degraded much more by the presence of a spectral hole (e.g. in the form of the absence of a wideband noise quantized to zero) than by the absence of a small spectral peak quantized to zero. A tonal component may be concentrated in a single spectral line, or may be spread over several spectral contiguous lines (for example i−1, i,i+1). A spectral region may, for example, comprise one or more spectral lines.

In an embodiment, the noise value calculator is configured to calculate a sum of logarithmized quantization error energies of the identified spectral regions to obtain the noise filling parameter. By calculating the sum of logarithmized quantization error energies of the identified spectral regions, the above-described relative emphasis of non-tonal spectral regions quantized to zero over tonal regions quantized to zero, can be obtained in an efficient manner.

Another embodiment according to the invention creates an encoded audio signal representation, for representing an audio signal. The encoded audio signal representation comprises an encoded quantized spectral domain representation of the audio signal and an encoded noise filling parameter. The noise filling parameter represents a quantization error of the spectral regions of the spectral domain representation quantized to zero and spaced from spectral regions of the spectral domain representation quantized to a non-zero value by at least a predetermined number of intermediate spectral regions. The above-described encoded audio signal representation is useable by the noise filler discussed above and can be obtained using the noise filling parameter calculator discussed above. The encoded audio signal representation allows for a reconstruction of the audio signal with particularly good audio quality because the noise filling parameter selectively reflects the quantization error of the quantized spectral domain representation for such spectral regions in which a meaningful noise information is present and which should be selectively considered for a noise-filling at the decoder side.

Another embodiment according to the invention creates a method for providing a noise filled representation of an audio signal.

Yet another embodiment according to the invention creates a method for providing a noise filling parameter on the basis of a quantized spectral representation of an audio signal.

Yet another embodiment according to the invention creates a computer program for implementing the abovementioned methods.

BRIEF DESCRIPTION OF THE DRAWINGS

Embodiments of the present invention will be detailed subsequently referring to the appended drawings, in which:

FIG. 3 is a pseudo program code for implementing the functionality of the noise filler of FIG. 1.

FIG. 6 is a pseudo program code for implementing the functionality of the noise filling parameter calculator according to FIG. 5;

DETAILED DESCRIPTION OF THE INVENTION

Noise Filler According to FIGS. 1-4

Figure 1:
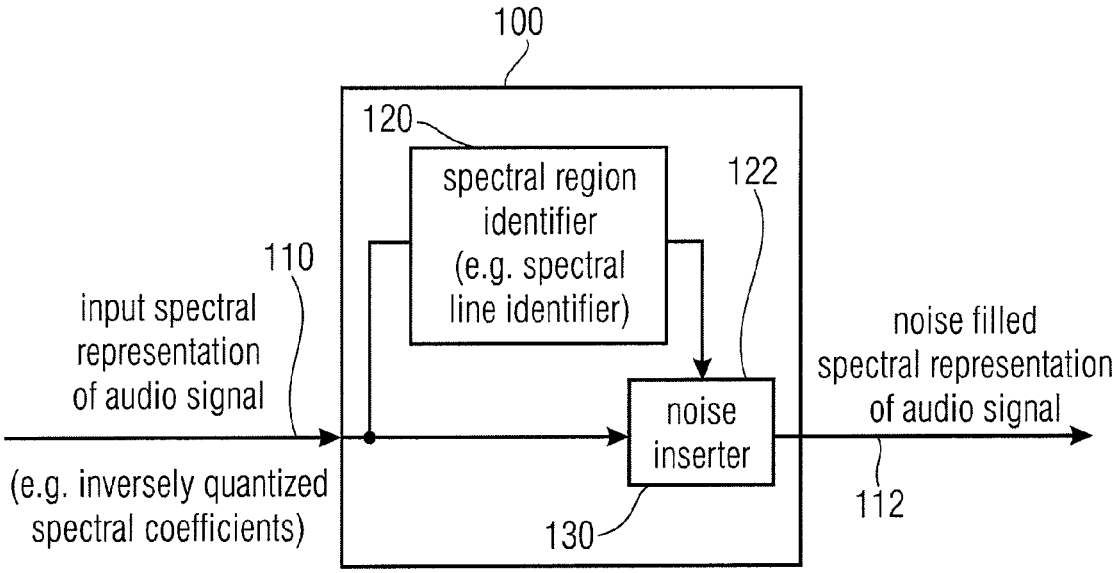
FIG. 1 is a block schematic diagram of a noise filler, according to an embodiment of the invention.

FIG. 1 shows a block schematic diagram of a noise filler 100, according to an embodiment of the invention. The noise filler 100 is configured to receive an input spectral representation 110 of an audio signal, for example in the form of decoded spectral coefficients (which may for example be quantized or inversely quantized). The noise filler 100 is also configured to provide a noise filled spectral representation 112 of the audio signal on the basis of the input spectral representation 110.

The noise filler 100 comprises a spectral region identifier 120, which is configured to identify spectral regions of the input spectral representation 110 spaced from non-zero spectral regions of the input spectral representation 110 by at least one intermediate spectral region, to obtain an information 122 indicating the identified spectral regions. The noise filler 100 also comprises a noise inserter 130, which is configured to selectively introduce noise into the identified spectral regions (described by the information 122), to obtain the noise filled spectral representation 112 of the audio signal.

Regarding the functionality of the noise filler 100, it can generally be said that the noise filler 100 selectively fills spectral regions (e.g. spectral lines or spectral bins) of the input spectral representation 110 with noise, for example by replacing spectral values of spectral lines quantized to zero with replacement spectral values describing a noise. In this manner, spectral holes or spectral gaps within the input spectral representation 110 can be filled, which may for example arise from a coarse quantization of the input spectral representation 110. However, the noise filler 100 does not introduce noise into all of the spectral lines quantized to zero (i.e. spectral lines, the spectral values of which are quantized to zero). Rather, the noise filler 100 only introduces noise into such spectral lines quantized to zero, which comprise a sufficient distance from any spectral lines quantized to a non-zero value. in this manner, the noise filling does not entirely fill spectral holes or spectral gaps, but maintains a spectral distance of at least one spectral region (or of at least any other predetermined number of spectral regions) between those spectral lines in which a noise is introduced and spectral lines quantized to a non-zero value. Thus, a spectral distance between filling noise, introduced into the spectral representation, and spectral lines quantized to a non-zero value is maintained, such that the psychoacoustically relevant spectral lines (which are not quantized to zero in the input spectral representation of the audio signal) can be clearly distinguished (due to the spectral distance of the predetermined number of one or more spectral regions) from the filling noise introduced into the spectrum by the noise filler. Accordingly, the psychoacoustically most relevant audio content (represented by non-zero spectral line values in the input spectral representation 110) can clearly be perceived, while large spectral holes are avoided. This is due to the fact that the noise filling is selectively omitted in the proximity of spectral lines of the input spectral representation quantized to a non-zero value, while the noise filling is executed in the central regions of spectral holes or spectral gaps.

Figure 2:
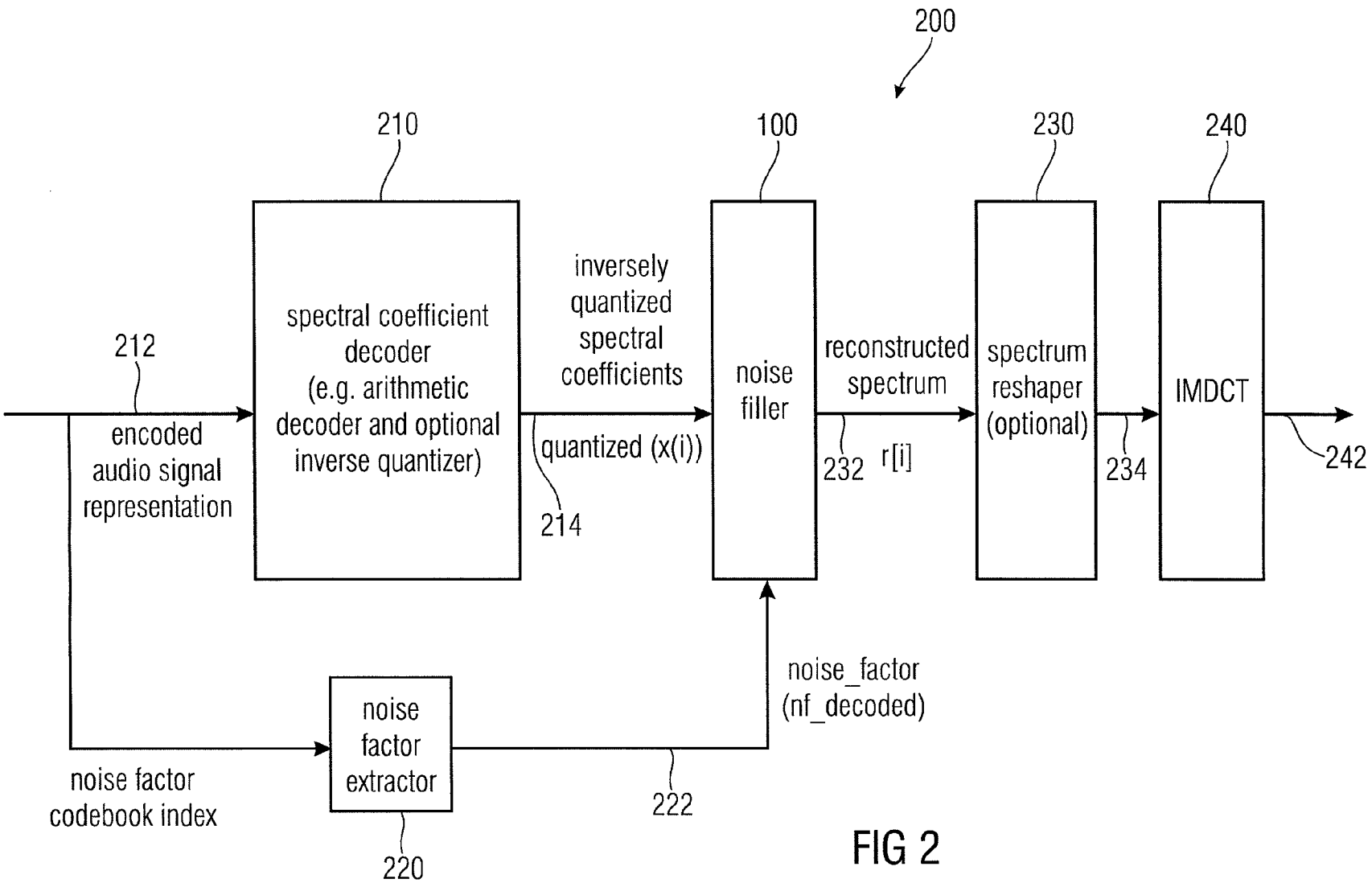
FIG. 2 is a block schematic diagram of an audio signal decoder comprising the noise filler according to the present invention.

In the following, an application environment for the noise filler 100 will be described taking reference to FIG. 2. FIG. 2 shows a block schematic diagram of an audio signal decoder 200, according to an embodiment of the invention. The audio signal decoder 200 comprises, as a key component, the noise filler 100. The audio signal decoder 200 also comprises a spectral coefficient decoder 210, which is configured to receive an encoded audio signal representation 212 and to provide a decoded, an optionally inversely quantized representation 214 of spectral coefficients of the encoded audio signal. The spectral coefficient decoder 210 may for example comprise an entropy decoder (e.g. arithmetic decoder or run length decoder) and, optionally, an inverse quantizer to derive the decoded representation 214 of the spectral coefficients (e.g. in the form of inversely quantized coefficients) from the encoded audio signal representation 212. The noise filler 100 is configured to receive the decoded representation 214 of spectral coefficients (which is optionally inversely quantized) as the input spectral representation 110 of the audio signal.

The audio signal decoder 200 also comprises a noise factor extractor 220, which is configured to extract a noise factor information 222 from the encoded audio signal representation 212 and to provide the extracted noise factor information 222 to the noise filler 100. The audio signal decoder 200 also comprises a spectrum reshaper 230, which is configured to receive a reconstructed spectrum representation 232 from the noise filler 100. The reconstructed spectrum representation 232 may for example be equal to the noise filled spectral representation 112 provided by the noise filler. The spectrum reshaper 230, which may be considered as optional, is configured to provide a spectrum information 234 on the basis of the reconstructed spectrum representation 232. The audio signal decoder 200 further comprises a spectral-domain to time-domain converter 240, which receives the spectrum representation 234 provided by the spectrum reshaper 230, or, in the absence of the spectrum reshaper 230, the reconstructed spectrum representation 232, and to provide on the basis thereof, a time-domain audio signal representation 242. The spectral-domain to time-domain converter 240 may for example be configured to perform an inverse modified discrete cosine transform (IMDCT).

In an embodiment, the noise filling at the decoder side comprises the following steps (or follows the next steps):

1. Decode the noise floor;
2. Decode the quantized values of the frequency lines;
3. Detect the spectral regions in the selected part of the spectra where a run length of zeros is higher than a minimal run length size; and
4. Apply a randomly generated sign to the decoded noise floor for each of the lines within the selected regions.

The noise floor is decoded as follows:

$$nf_decoded=0.0625*(8-index).$$

The detected spectral regions are, for example, selected in the same manner as it is done at the encoder side (which will be described below).

A memoryless Gaussian noise in the MDCT domain is generated by a spectrum with the same amplitude for all lines but with random signs. So, for each of the lines within the selected regions, the decoder generates a random sign (−1 or +1) and applies it to the decoded noise floor. However, other methods of providing a noise contribution can be applied as well.

Figure 4:
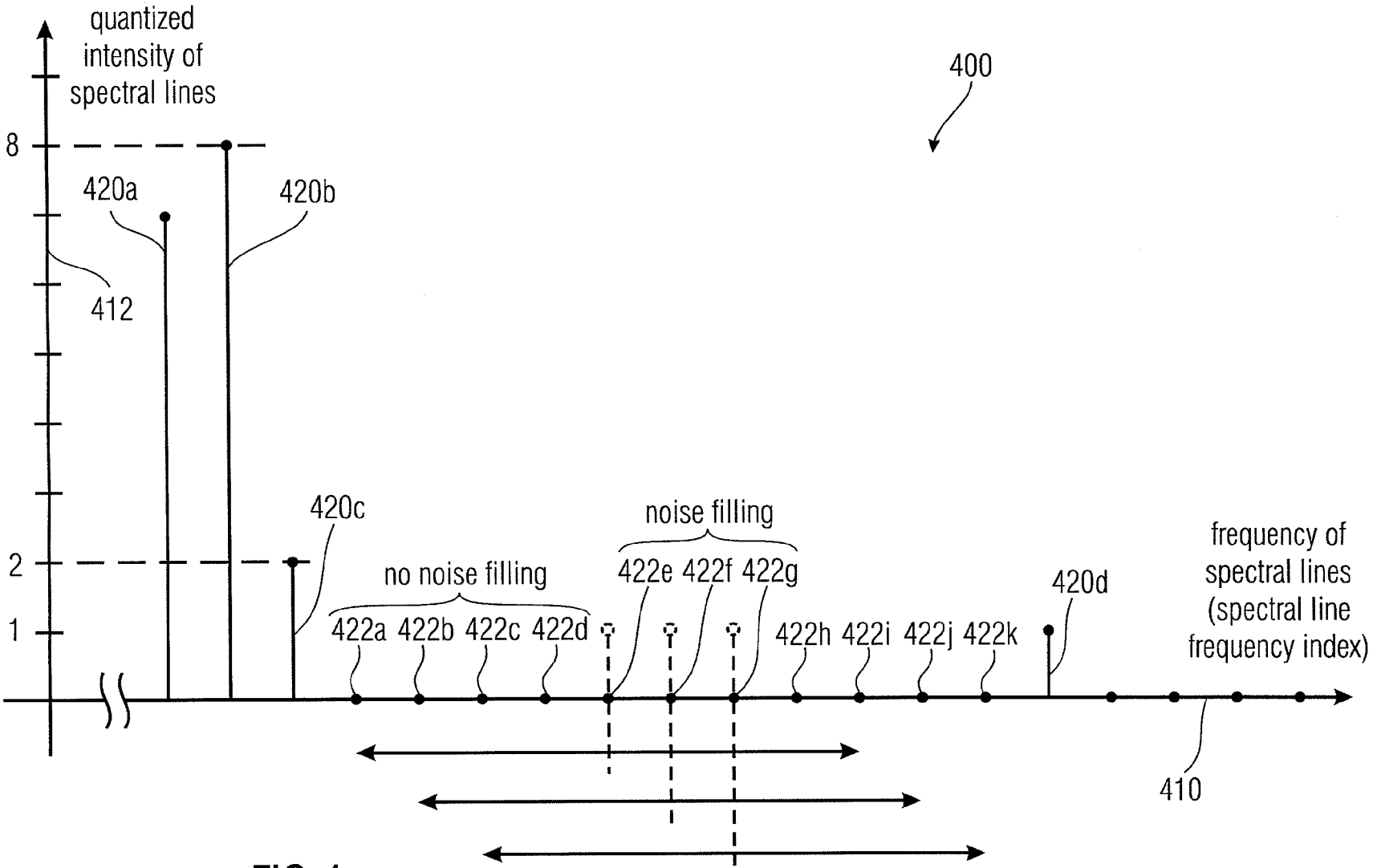
FIG. 4 is a graphical representation of an identification of spectral regions, which may be performed in the noise filler according to FIG. 1.

In the following, some details will be described taking reference to FIGS. 1, 2, 3, and 4, wherein FIG. 3 shows a pseudo program code of an algorithm for noise filling at the decoder side, which may be performed by the noise filler 100, and wherein FIG. 4 shows a graphical representation of the noise filling.

To start with, the decoding of the noise floor may be performed by the noise factor extractor 220, which receives, for example, a noise factor index (also briefly designated as "index") and to provide on the basis thereof the decoded noise factor value 222 (also designated with "nf_decoded"). The noise factor index may for example be encoded using three or four bits, and it may for example be an integer value in the range between 0 and 7, or an integer value in a range between 0 and 15.

The quantized values of the frequency lines (also designated as "spectral lines" or "spectral bins") may be provided by the spectral coefficient decoder 210. Accordingly, quantized (or optionally, inversely quantized) spectral line values (also designated as "spectral coefficients") are obtained, which are designated as "quantized (x(i))". Here, i designates a frequency index of the spectral line values.

Subsequently, spectral regions are detected by the noise filler 100 in a selected part of the spectra (e.g. in an upper portion of the spectrum starting from a predetermined spectral line frequency index i) where a run length of zeros (i.e. of quantized spectral line values quantized to zero) is higher than a minimal run length size. The detection of such spectral regions is performed by a first portion 310 of the algorithm 300 of FIG. 3. As can be seen from the first portion 310 of the algorithm 300, a set R of detected regions is initialized to be an empty set at the beginning of the algorithm (R={ };).

In the example of the algorithm of FIG. 3, a minimal run length is set to a fixed value of 8, but naturally any other value can be chosen.

Subsequently, it is determined for a plurality of spectral lines under consideration (designated by running variable "line index") whether each of these spectral lines under consideration comprises a double-sided environment of spectral lines quantized to zero (and whether the spectral line under consideration is itself quantized to zero). For example, all the lines in the second half of the spectra may successively be considered as lines under consideration, wherein a line which is currently under consideration is designated by a frequency index "line index". For a line under consideration designated by the "line index", a sum of quantized spectral coefficients "quantized(x(i))" in an environment ranging from a spectral line frequency index of "line index−(MinimalRunLength)/2" to a spectral line frequency index of "line index+MinimalRunLength)/2" is computed. If it is found that the sum of the spectral line values in said environment of the spectral line currently under consideration (having spectral line frequency index "line index") is zero, then the spectral line presently under consideration (or, more precisely, the spectral line frequency index "line index" thereof) is added to the set R of detected regions (or detected spectral lines). Consequently, if a spectral line frequency index of a spectral line is added to the set R, this means that the spectral lines having line indices between "line index−MinimalRunLength)/2" and "line index+MinimalRunLength)/2" all comprise spectral line values quantized to zero.

Accordingly, in the first portion 310 of the pseudo program code 310, a set R of spectral line frequency indices "line index" is obtained, which enumerates those (and only those) spectral lines of the spectral portion under consideration which are spaced "sufficiently" (i.e. by at least MinimalRunLength/2 lines) from any spectral lines quantized to a non-zero value.

The detection of such region is illustrated in FIG. 4, which shows a graphical representation 400 of a spectrum. An abscissa 410 describes a frequency of spectral lines in terms of a spectral line frequency index "line index". An ordinate 412 describes an intensity (e.g. amplitude or energy) of the spectral lines. As can be seen, the portion of the spectrum illustrated in the graphical representation 400 comprises four spectral lines 420*a*, 420*b*, 420*c*, and 420*d*, quantized to a non-zero value. Further, between the spectral lines 420*c* and 420*d*, there are 11 spectral lines 422*a*-422*k* quantized to zero. Further, it is assumed that a spectral line is only considered to be spaced sufficiently from a spectral line quantized to a non-zero value if there are at least four spectral lines quantized to zero between the spectral line presently under consideration and any other spectral line quantized to a non-zero value (and naturally, if the spectral line presently under consideration is itself quantized to zero). However, when considering the spectral line 422*a*, it will be found that the spectral line 422*a* is immediately adjacent to the spectral line 420*c*, which is not quantized to zero, such that the spectral line frequency index of the spectral line 422*a* will not be part of the set R computed according to the first part 310 of the algorithm 300. Similarly, it will be found that the spectral lines 422*b*, 422*c*, and 422*d* are not spaced far enough from any spectral lines quantized to a non-zero value, such that the spectral line frequency indices of the spectral lines 422*b* to 422*d* will also not be part of the set R. In contrast it will be recognized that spectral line 422*e* is spaced far enough from any spectral lines quantized to a non-zero value, because the spectral line 422*e* is a center line (or, more generally, a central line), of a sequence of 9 contiguous spectral lines all quantized to zero. Accordingly, a spectral line frequency index of the spectral line 422*e* will be part of the set R computed in the first portion 310 of the algorithm 300. The same also holds for the spectral lines 422*f* and 422*g*, such that the spectral line frequency indices of the spectral lines 422*f* and 422*g* will be part of the set R determined in the first portion 310 of the algorithm 300, as the spectral lines 422*f*, 422*g* are spaced far enough from any lower-frequency spectral lines 420*a*, 420*b*, and 420*c*, quantized to a non-zero value and from any higher frequency spectral lines quantized to a non-zero value. On the other hand, the spectral lines 422*h*, 422*i*, 422*j*, and 422*k* will not be part of the set R, because said spectral lines are located too closely, in terms of frequency, besides the spectral line 420*d* quantized to a non-zero value.

Accordingly, the set R will not comprise spectral line frequency indices of the spectral lines 420*a*, 420*b*, 420*c*, 420*d*, because said spectral lines are quantized to a non-zero value. In addition, spectral line frequency indices of spectral lines 422*a*, 422*b*, 422*c*, 422*d*, 422*h*, 422*i*, 422*j*, and 422*k*, will not be part of the set R, because said spectral lines are located too closely beside the spectral lines 420*a*, 420*b*, 420*c*, and 420*d*. In contrast, spectral line frequency indices of spectral lines 422*e*, 422*f*, 422*g*, will be included in the set R, because said spectral lines are themselves quantized to zero and spaced far enough from any adjacent non-zero spectral lines.

The algorithm 300 also comprises a second portion 320 of decoding the noise floor, wherein a noise value index ("index" in the program code portion 320) is converted into a decoded noise figure value ("nf_decoded" in the program code 300).

The program code 300 also comprises a third portion 330 of filling the identified spectral lines, i.e. spectral lines the spectral line frequency indices i of which are in the set R, with noise. For this purpose, the spectral values of the identified spectral lines (designated for example, with x(i), wherein running variable i subsequently takes all spectral line frequency indices included in the set R) are set to noise filling values. The noise filling values are for example obtained by multiplying the decoded noise filling value (nf_decoded) with a random number or pseudo random number (designated with "random(−1, +1)"), wherein the random or pseudo random number may for example randomly or pseudo-randomly take the numbers −1 and +1. However, different provision of a random or pseudo random noise is naturally possible.

The noise filling is also illustrated in FIG. 4. As can be seen in FIG. 4, the zero spectral values of the spectral lines 422*e*, 422*f*, and 422*g* are replaced by noise filling values (illustrated by dotted lines in FIG. 4).

Figure 5:
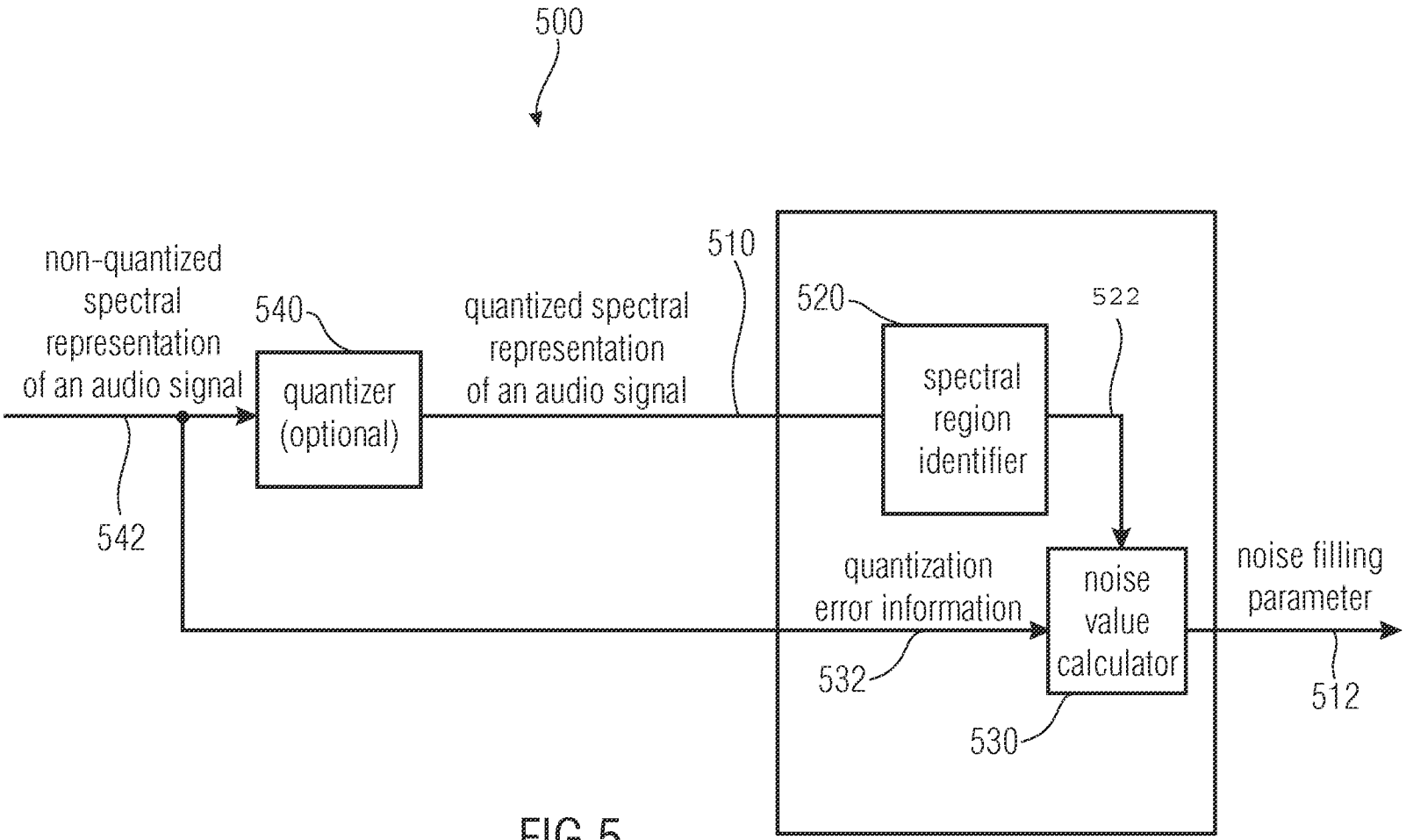
FIG. 5 is a block schematic diagram of a noise filling parameter calculator according to an embodiment of the invention.

Noise Filling Parameter Calculator According to FIGS. 5 and 6

FIG. 5 shows a block schematic diagram of a noise filling parameter calculator 500. The noise filling parameter calculator is configured to obtain a quantized spectral representation 510 of an audio signal and to provide, on the basis thereof, a noise filling parameter 512. The noise filling parameter calculator 500 comprises a spectral region identifier 520, which is configured to receive the quantized spectral representation 510 of the audio signal and to identify spectral regions (e.g. spectral lines) of the quantized spectral representation 510 spaced from non-zero spectral regions of the quantized spectral representation 510 by at least one intermediate spectral region (e.g. spectral line), to obtain an information 522 describing identified spectral regions (e.g. identified spectral lines). The noise filling parameter calculator 500 further comprises a noise value calculator 530 configured to receive a quantization error information 532 and to provide the noise filling parameter 512. For this purpose, the noise value calculator is configured to selectively consider quantization errors of the identified spectral regions, described by the information 522, for a calculation of the noise filling parameter 512.

The quantization error information 532 may for example be identical to an energy information (or intensity information) describing energies (or intensities) of those spectral lines which are quantized to zero in the quantized spectral representation 510.

The noise filling parameter calculator 500 may optionally comprise a quantizer 540, which is configured to receive a non-quantized spectral representation 542 of an audio signal and to provide the quantized spectral representation 510 of the audio signal. The quantizer 540 may have an adjustable quantization resolution, which may for example be individually adjustable per spectral line, or per spectral band (e.g. in dependence on a psychoacoustic relevance of the spectral lines or spectral bands, obtained using a psychoacoustic model). The functionality of the variable-resolution quantizer may be equal to the functionality described in the International Standards ISO/IEC 13818-7 and ISO/IEC 14496-3. In particular, the quantizer 540 may be adjusted such that there are spectral gaps or spectral holes in the quantized spectral representation 510 of the audio signal, i.e. contiguous regions of adjacent spectral lines quantized to zero.

Moreover, the non-quantized spectral representation 542 may serve as the quantization error information 532, or the quantization error information 532 may be derived from the non-quantized spectral representation 542.

In the following, the functionality of the noise filling parameter computation, which may be performed by the noise filling parameter calculator 500 will be described in detail. In the noise filling parameter computation at the encoder side, the noise filling is advantageously applied in the quantization domain. In this manner, the introduced noise is shaped afterwards by the psychoacoustic relevant inverse filter. The energy of the noise introduced by the decoder is calculated and encoded at the encoder side following the next steps:

1. Get the quantized values of the frequency lines;
2. Select only a part of the spectra;
3. Detect the spectral regions in the selected part of the spectra where a run length of zeros is higher than a minimal run length size;
4. Calculate the geometric mean of the quantization error over the previously detected regions; and
5. Quantize uniformly the geometric mean with 3 bits.

Regarding the first step, the quantized values of the frequency lines may be obtained using the quantizer 540. The quantized values of the frequency lines are therefore represented by the quantized spectral representation 510.

Regarding the second step, which may be considered as optional, it should be noted that the computation of the noise filling is advantageously performed on the basis of a high frequency portion of the spectra. In an embodiment, the energy of the noise (called noise floor) is calculated only on the second half of the spectra, i.e. for the high frequencies (but not for the lower frequencies). Indeed, usually the high frequencies (upper part of the spectrum) are less perceptually important than the low frequencies, and the zero-quantized values occur mostly in the second half of the spectra. Furthermore, adding in the noise in the high frequencies is less prone to obtain a final noisy sound restitution.

Regarding the third step, by restricting the noise filling on the spectral regions where a run length of zero-quantized values occurs, it is avoided that the noise filling affects the non-zeroed values too much. In this manner, the noise filling is not applied in the neighborhood of the non-zeroed values, and the original tonality of these lines is the then better preserved. The minimal run length size is fixed to 8 in an embodiment. This means that the 8 lines surrounding a non-zeroed value are not affected by the noise filling (and are consequently not considered for the calculation of a noise value).

Regarding the fourth step, the quantization error in the quantized domain are in the range [−0.5; 0.5], and is assumed to be uniformly distributed. The energy of quantization errors of the detected regions is average in the logarithmic domain (i.e. geometric mean). The noise floor, nf, is then calculated as follows:

$$nf=\mathrm{power}(10,\mathrm{sum}(\log 10(E(x(i))))/(2*n)).$$

In the above, sum( ) is the sum of the logarithmic energies, log 10(E( ), of the individual lines x(i) within the detected regions, and n the number of lines within these regions. The noise floor, nf, is between 0 and 0.5. Such a calculation permits to take the original spectral flatness of the zeroed values into account, and then get information about their tonality/noisiness characteristics.

If the zeroed values are very tonal, the noise floor (computer in the apparatus 500) will go toward zero, and a low noise floor will be added at the decoder (e.g. at the decoder 100, 200 described above). If the zeroed values are really noisy, the noise floor will be high, and the noise filling can be seen as a highly parametric coding of the zeroed spectral lines, like PNS (Perceptual Noise Substitution) (see also reference [4]).

Regarding the fifth step, the quantization index ("index") of the noise floor is then calculated as follows:

$$index=\max(0,\min(7,\mathrm{int}(8-16*nf))).$$

The index is transmitted, for example, on 3 bits.

In the following, the algorithm for computing the noise filling parameter will be described taking reference to FIG. 6, which shows a pseudo program code 600 of such an algorithm for obtaining the noise filling parameter, according to an embodiment of the invention. The algorithm 600 comprises a first portion 610 of detecting regions which should be considered for the computation of the noise filling parameter. Identified regions (e.g. spectral lines) are described by the set R, which may for example comprise spectral line frequency indices ("line index") of identified spectral lines. Spectral lines may be identified, which are themselves quantized to zero and which are further spaced, far enough, from any other spectral lines quantized to a non-zero value.

The first portion 610 of the program 600 may be identical to the first portion 310 of the program 300. Accordingly, the quantized spectral representation ("quantized (x(i))") used in the algorithm 600 may for example be identical to the quantized spectral representation ("quantized x(i))") used in the algorithm 300 at the decoder side. In other words, the quantized spectral representation used at the encoder side may be transmitted, in an encoded form, to the decoder in a transmission system comprising an encoder and a decoder.

The algorithm 600 comprises a second portion 620 of computing the noise floor. In the computation of the noise floor, only those spectral regions (or spectral lines) described by the set R computed in the first portion 610 of the algorithm 600 are considered. As can be seen, the noise filling value nf is first initialized to zero. The number of considered spectral lines (n) is also first initialized to zero. Subsequently, the energies of all the spectral lines, line indices of which are included in the set R, are summed up, wherein the energies of the spectral lines are logarithmized before the summing. For example, a logarithm to the base of 10 (log 10) of the energies (E(x(i))) of the spectral lines may be summed. It should be noted here that the actual energy of the spectral lines before quantization (designated with "E or energy (x(i))") is summed up in logarithmized form. The number of spectral lines considered is also counted. Thus, after the execution of the second portion 620 of the algorithm 600, the variable nf indicates a logarithmic sum of energies of the identified spectral lines before quantization, and the variable n describes the number of identified spectral lines.

Algorithm 600 also comprises a third portion 630 of quantizing the value nf, i.e. the logarithmic sum of the identified spectral lines. A mapping equation as described above or as shown in FIG. 6 may be used.

Figure 7:
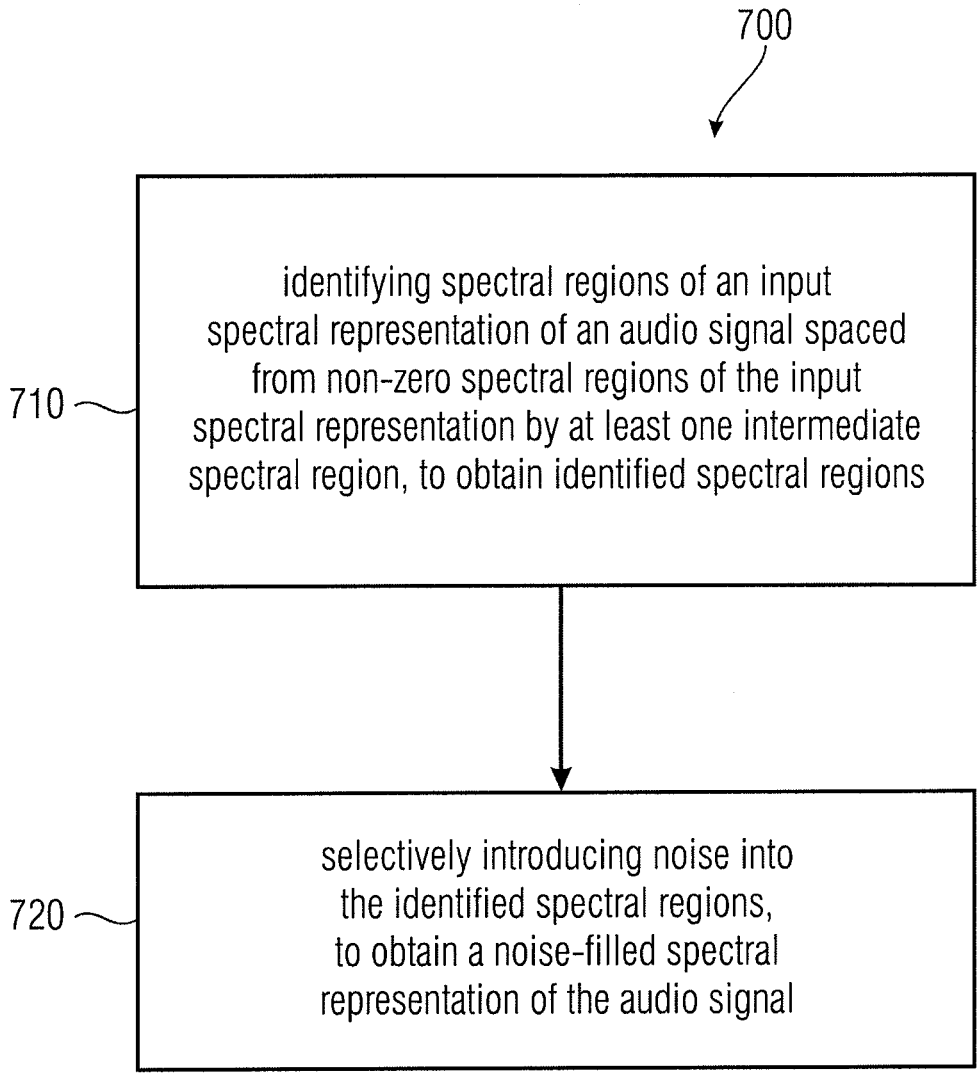
FIG. 7 is a flow chart of a method for providing a noise filled spectral representation of an audio signal on the basis of an input spectral representation of the audio signal.

Method According to FIG. 7

FIG. 7 shows a flow chart of a method for providing a noise-filled spectral representation of an audio signal on the basis of an input spectral representation of the audio signal. The method 700 of FIG. 7 comprises a step 710 of identifying spectral regions of an input spectral representation of an audio signal spaced from non-zero spectral regions of the input spectral representation by at least one intermediate spectral region, to obtain identified spectral regions. The method 700 also comprises a step 720 of selectively introducing noise into the identified spectral regions, to obtain a noise-filled spectral representation of the audio signal.

The method 700 may be supplemented by any of the features and functionalities described herein with reference to the inventive noise filler.

Figure 8:
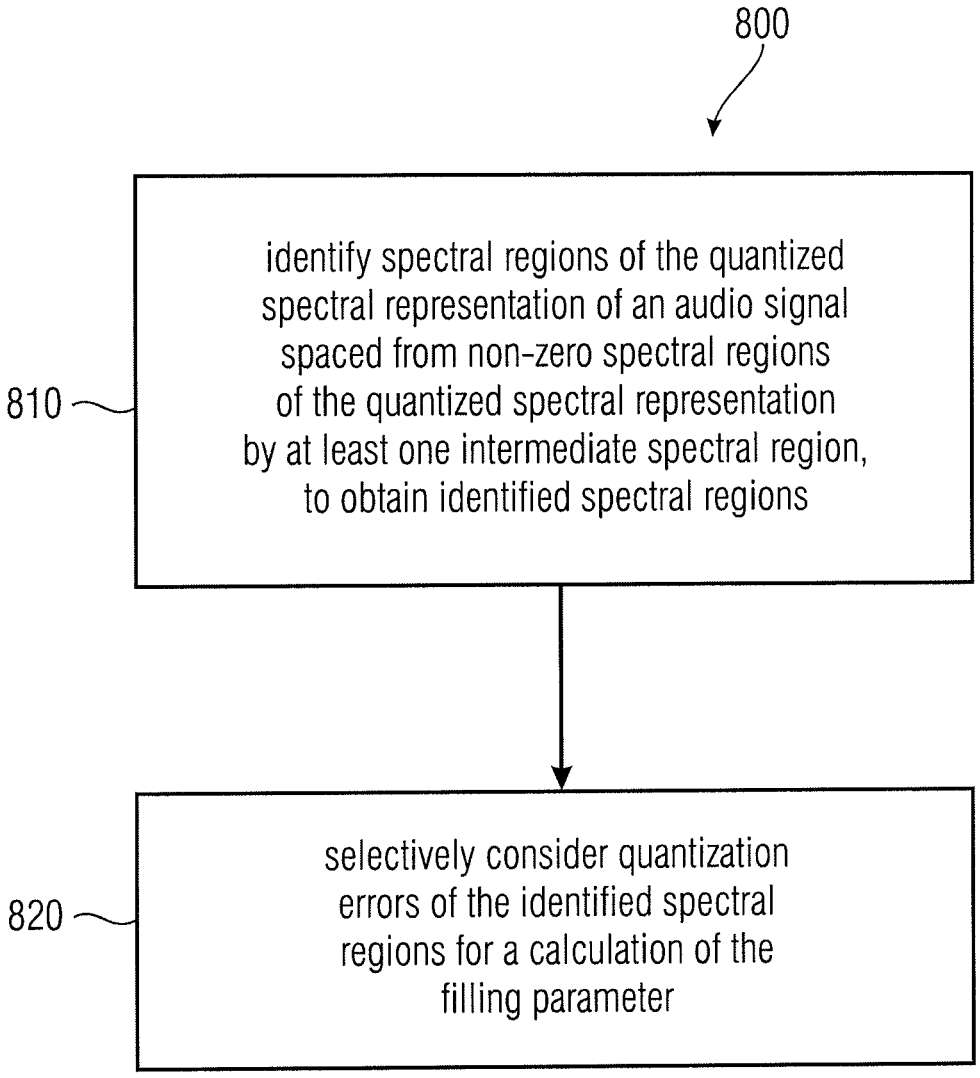
FIG. 8 is a flow chart of a method for providing a noised filling parameter on the basis of a quantized spectral representation of an audio signal.

Method According to FIG. 8

FIG. 8 shows a flowchart of a method for providing a noise filling parameter on the basis of a quantized spectral representation of an audio signal. The method 800 comprises a step 810 of identifying spectral regions of the quantized spectral representation of an audio signal spaced from non-zero spectral regions of the quantized spectral representation by at least one intermediate spectral region, to obtain identified spectral regions. The method 800 also comprises a step 820 of selectively considering quantization errors of the identified spectral regions for a calculation of the filling parameter.

The method 800 can be supplemented by any of the features and functionalities described herein with respect to the noise filling parameter calculator.

Figure 9:
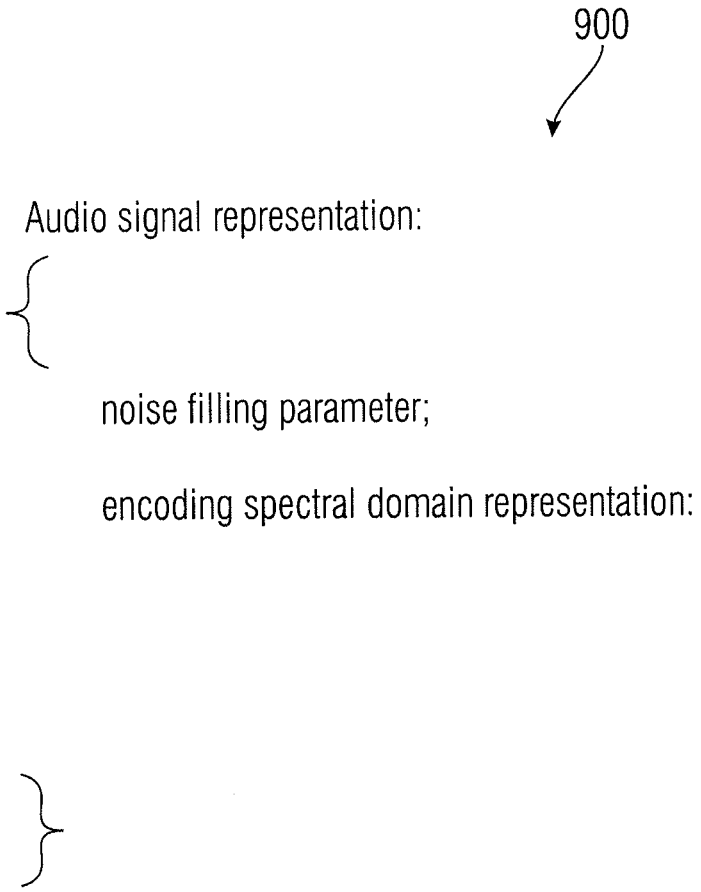
FIG. 9 is a graphical representation of an audio signal representation, according to an embodiment of the invention.

Audio Signal Representation According to FIG. 9

FIG. 9 shows a graphical representation of an audio signal representation, according to an embodiment of the invention. The audio signal representation 900 may for example form the basis for the input spectral representation 110. The audio signal representation 900 may also take over the functionality of the encoded audio signal representation 212. The audio signal representation 900 may be obtained using the noise filling parameter calculator 500, wherein the audio signal representation 900 may for example comprise the quantized spectral representation 510 of the audio signal and the noise filling parameter 512, for example, both in encoded form.

In other words, the encoded audio signal representation 900 may represent an audio signal. The encoded audio signal representation 900 comprises an encoded quantized spectral domain representation of the audio signal and also an encoded noise filling parameter. The noise filling parameter represents a quantization error of spectral regions of the spectral domain representation quantized to zero and spaced from spectral regions of the spectral domain representation quantized to a non-zero value by at least one intermediate spectral region.

Naturally, the audio signal representation 900 may be supplemented by any of the information described above.

Implementation Alternatives

Depending on certain implementation requirements, embodiments of the invention can be implemented in hardware or in software. The implementation can be performed using a digital storage medium, for example a floppy disk, a DVD, a CD, a ROM, a PROM, an EPROM, an EEPROM or a FLASH memory, having electronically readable control Signals stored thereon, which cooperate (or are capable of cooperating) with a programmable computer System such that the respective method is performed.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium) comprising the computer program for performing one of the methods described herein.

A further embodiment of the inventive method is, therefore, a data stream or a sequence of signals representing the computer program for performing on of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein.

CONCLUSION

To summarize the above, the present invention enhances the audio coding tool "noise filling" by considering the input signal and the decoded signal characteristics when both computing the noise filling parameters at the encoder side, and applying the noise at the decoder side. In an embodiment of the invention, the tonality/noisiness of the zero-quantized spectral lines is estimated and is used for the noise floor estimation. This noise floor is then transmitted to the decoder which applies the noise filling to the zero-quantized values occurring is specific regions of the spectra. These regions are selected based on the characteristics of the decoded spectra.

Regarding the context of the invention, it can be noted that the invention was applied to a transform-based coding which uses a scalar quantization on MDCT. The MDCT coefficients are previously normalized by a curve calculated based on perceptual clues. The curve is deduced from a previous LPC (Linear Prediction Coding) analysis stage by weighting the LPC coefficients, as it is done in the TCX mode of AMR-WB+ (see reference [1]). From the weighted coefficients, a perceptual weighting filter is designed and applied before the MDCT. The inverse filter is also applied at the decoder side after the inverse MDCT. This inverse perceptual weighting filter shapes the quantization noises in a way that it minimizes or masks the perceived noise.

In embodiments according to the invention, the disadvantages of the conventional technology are overcome. The noise filling is conventionally applied in a systematic manner on the zero-quantized values considering only a spectral envelope-based threshold, a masking threshold, or an energy threshold. The conventional technology considers neither the characteristics of the input signal nor the characteristics of the decoded signal. Thus, conventional apparatus may introduce undesirable additional artifacts, especially noise artefacts, and cancels the advantages of such a tool.

In contrast, embodiments according to the invention allow for an improved noise filling with reduced artifacts, as is discussed above.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

References:

[1] "Extended Adaptive Multi-Rate-Wideband (AMR-WB+) codec", 3GPP TS 26.290 V6.3.0, 2005-06, Technical Specification

[2] Ragot et al, "ITU-T G.729.1: AN 8-32 Kbit/S Scalable Coder Interoperable with G.729 for Wideband Telephony and Voice Over IP", Vol. 4, ICASSP 07, 15-20 April 2007

[3] "AUDIO CODING", International Application No.: PCT/IB2002/001388, Applicant: KONINKLIJKE PHILIPS ELECTRONICS N.V. [NL/NL]; Groenewoudseweg 1 NL-5621 BA Eindhoven (NL). Inventors: TAORI, Rakesh; Prof Holstlaan 6 NL-5656 AA Eindhoven (NL) and VAN DE PAR, Steven, L., J., D., E.; Prof. Holstlaan 6 NL-5656 AA Eindhoven (NL).

[4] Generic Coding of Moving Pictures and Associated Audio: Advanced Audio Coding. International Standard 13818-7, ISO/IEC JTC1/SC29/WG11 Moving Pictures Expert Group, 1997.

The invention claimed is:

1. A noise filler for providing a noise-filled spectral representation of an audio signal on the basis of an input spectral representation of the audio signal, the noise filler comprising:

a spectral region identifier configured to identify spectral regions of the input spectral representation which are quantized to zero and which are spaced from non-zero spectral regions of the input spectral representation by at least one intermediate spectral region, to acquire identified spectral regions; and a noise inserter configured to selectively introduce noise into the identified spectral regions to acquire the noise-filled spectral representation of the audio signal;

wherein the noise filler is implemented using a hardware apparatus, or using a computer, or using a combination of a hardware apparatus and a computer.

2. The noise filler according to claim 1, wherein the spectral region identifier is configured to identify, as identified spectral regions, spectral lines of the input spectral representation, which are quantized to zero and which comprise at least a first predetermined number of lower frequency neighbor spectral lines quantized to zero and at least a second predetermined number of higher frequency neighbor spectral lines quantized to zero, as identified spectral regions;

wherein the first predetermined number is greater than or equal to 1, and wherein the second predetermined number is greater than or equal to 1; and wherein the noise inserter is configured to selectively introduce noise into the identified spectral lines while leaving spectral lines quantized to a non-zero value and spectral lines quantized to zero, but not comprising the first predetermined number of lower frequency neighbor spectral lines quantized to zero, or the second predetermined number of higher frequency neighbor spectral lines quantized to zero unaffected by the noise filling.

3. The noise filler according to claim 2, wherein the first predetermined number is equal to the second predetermined number.

4. The noise filler according to claim 1, wherein the noise filler is configured to introduce noise only into spectral regions in an upper portion of the input spectral representation of the audio signal while leaving a lower portion of the input spectral representation of the audio signal unaffected by the noise filling.

5. The noise filler according to claim 1, wherein the spectral region identifier is configured to sum quantized intensity values of spectral regions in a predetermined double-sided spectral neighborhood of a given spectral region, to acquire a sum value, and to evaluate the sum value to decide whether the given spectral region is an identified spectral region or not.

6. The noise filler according to claim 1, wherein the spectral region identifier is configured to scan a range of spectral regions of the input spectral representation to detect contiguous sequences of spectral regions quantized to zero, and to recognize one or more central spectral regions of the detected contiguous sequences as identified spectral regions.

7. A noise filling parameter calculator for providing a noise filling parameter on the basis of a quantized spectral representation of an audio signal, the noise filling parameter calculator comprising:

a spectral region identifier configured to identify spectral regions of the quantized spectral representation spaced from non-zero spectral regions of the quantized spectral representation by at least one intermediate spectral region, to acquire identified spectral regions; and a noise value calculator configured to selectively consider quantization errors of the identified spectral regions for a calculation of the noise filling parameter;

wherein the noise filling parameter calculator is implemented using a hardware apparatus, or using a computer, or using a combination of a hardware apparatus and a computer.

8. The noise filling parameter calculator according to claim 7, wherein the spectral region identifier is configured to identify spectral lines of the input spectral representation, which are quantized to zero and which comprise at least a first predetermined number of lower frequency neighbor spectral lines quantized to zero and at least a second predetermined number of higher frequency neighbor spectral lines quantized to zero, as identified spectral regions;

wherein the first predetermined number is greater than or equal to 1, and wherein the second predetermined number is greater than or equal to 1; and wherein the noise value calculator is configured to selectively consider quantization errors of the identified spectral regions for a calculation of the noise filling parameter while leaving spectral lines quantized to a non-zero value and spectral line quantized to zero, but not comprising the first predetermined number of lower frequency neighbors spectral lines quantized to zero, or the second predetermined number of higher frequency neighbor spectral lines quantized to zero out of consideration for the calculation of the noise filling parameter.

9. The noise filling parameter calculator according to claim 7, wherein the noise value calculator is configured to consider actual energies of the quantization errors of the identified spectral regions for the calculation of the noise filling parameter.

10. The noise filling parameter calculator according to claim 7, wherein the noise value calculator is configured to emphasize a non-tonal quantization error energy distributed over a plurality of identified spectral regions in relation to a tonal quantization error energy concentrated in a single spectral region or in a plurality of contiguous spectral lines.

11. The noise filling parameter calculator according to claim 7, wherein the noise value calculator is configured to calculate a sum of logarithmized quantization error energies of the identified spectral regions, to acquire the noise filling parameter.

12. A method for providing a noise-filled spectral representation of an audio signal on the basis of an input spectral representation of the audio signal, the method comprising:

identifying spectral regions of the input spectral representation spaced from non-zero spectral regions of the input spectral representation by at least one intermediate spectral region, to acquire identified spectral regions; and selectively introducing noise into the identified spectral regions to acquire the noise-filled spectral representation of the audio signal;

wherein the identifying and the introducing steps are performed by using a hardware apparatus, or using a computer, or using a combination of a hardware apparatus and a computer.

13. A method for providing a noise filling parameter on the basis of a quantized spectral representation of an audio signal, the method comprising:

identifying spectral regions of the quantized spectral representation spaced from non-zero spectral regions of the quantized spectral representation by at least one intermediate spectral region to acquire identified spectral regions; and selectively considering quantization errors of the identified spectral regions for a calculation of the noise filling parameter;

wherein the identifying and the considering steps are performed by using a hardware apparatus, or using a computer, or using a combination of a hardware apparatus and a computer.

14. A computer-readable digital storage medium having stored thereon a computer program having a program code for performing, when running on a computer or microprocessor, a method for providing a noise-filled spectral representation of an audio signal on the basis of an input spectral representation of the audio signal, the method comprising:

identifying spectral regions of the input spectral representation spaced from non-zero spectral regions of the input spectral representation by at least one intermediate spectral region, to acquire identified spectral regions; and selectively introducing noise into the identified spectral regions to acquire the noise-filled spectral representation of the audio signal, when the computer program runs on a computer.

15. A computer-readable digital storage medium having stored thereon a computer program having a program code for performing, when running on a computer or microprocessor, a method for providing a noise filling parameter on the basis of a quantized spectral representation of an audio signal, the method comprising:

identifying spectral regions of the quantized spectral representation spaced from non-zero spectral regions of the quantized spectral representation by at least one intermediate spectral region to acquire identified spectral regions; and selectively considering quantization errors of the identified spectral regions for a calculation of the noise filling parameter, when the computer program runs on a computer.

* * * * *